US008110075B2

(12) United States Patent
Sundstrom et al.

(10) Patent No.: US 8,110,075 B2
(45) Date of Patent: Feb. 7, 2012

(54) COATED CUTTING TOOL FOR GENERAL TURNING IN HEAT RESISTANT SUPER ALLOYS (HRSA)

(75) Inventors: Erik Sundstrom, Fagersta (SE); Rachid M'Saoubi, Fagersta (SE); Jon Andersson, Fagersta (SE)

(73) Assignee: Seco Tools AB, Fagersta (SE)

( * ) Notice: Subject to any disclaimer, the term of this patent is extended or adjusted under 35 U.S.C. 154(b) by 0 days.

(21) Appl. No.: 13/217,820

(22) Filed: Aug. 25, 2011

(65) Prior Publication Data

US 2011/0303061 A1 Dec. 15, 2011

Related U.S. Application Data

(62) Division of application No. 12/195,578, filed on Aug. 21, 2008, now Pat. No. 8,034,438.

(30) Foreign Application Priority Data

Aug. 24, 2007 (SE) ..... 0701910

(51) Int. Cl.
*C23C 16/00* (2006.01)

(52) U.S. Cl. ..... 204/192.16; 204/192.15; 407/119

(58) Field of Classification Search ..... 204/192.15, 204/192.16; 407/119
See application file for complete search history.

(56) References Cited

U.S. PATENT DOCUMENTS

| | | | |
|---|---|---|---|
| 5,750,247 | A | 5/1998 | Bryant |
| 6,214,287 | B1 | 4/2001 | Waldenstrom |
| 6,273,930 | B1 | 8/2001 | Waldenstrom |
| 6,309,738 | B1 | 10/2001 | Sakurai |
| 6,612,787 | B1 | 9/2003 | North |
| 6,884,497 | B2 | 4/2005 | Sulin |
| 7,727,621 | B2 | 6/2010 | Nordlof |
| 7,767,319 | B2 | 8/2010 | Åkesson |
| 2003/0175536 | A1 | 9/2003 | Penich |
| 2005/0129951 | A1 | 6/2005 | Collin |
| 2007/0154739 | A1 | 7/2007 | Martensson |
| 2008/0187775 | A1 | 8/2008 | Ruppi |

FOREIGN PATENT DOCUMENTS

| | | |
|---|---|---|
| EP | 1 795 628 | 6/2007 |
| EP | 1 798 308 | 6/2007 |
| EP | 1 953 269 | 8/2008 |
| JP | 09-295204 | 11/1997 |
| JP | 2003-127003 | 5/2003 |
| JP | 2006-281363 | 10/2006 |

*Primary Examiner* — Archene Turner
(74) *Attorney, Agent, or Firm* — Young & thompson

(57) ABSTRACT

Coated cemented carbide inserts are particularly useful in general turning of superalloys. The inserts are formed from a cemented carbide of WC about 5.0-7.0 wt-% Co, and about 0.22-0.43 wt-% Cr, where the substrate has a coercivity (Hc) of about 19-28 kA/m. The coating contains a single layer of $(Ti_xAl_{1-x})N$-layer, where x is 0.25-0.50, with a crystal structure of NaCl type, a total thickness of about 3.0-5.0 μm, (200)-texture, and a compressive residual strain of about $2.5\times10^{-3}$-$5.0\times10^{-3}$, optionally containing an outermost TiN-layer.

20 Claims, 1 Drawing Sheet

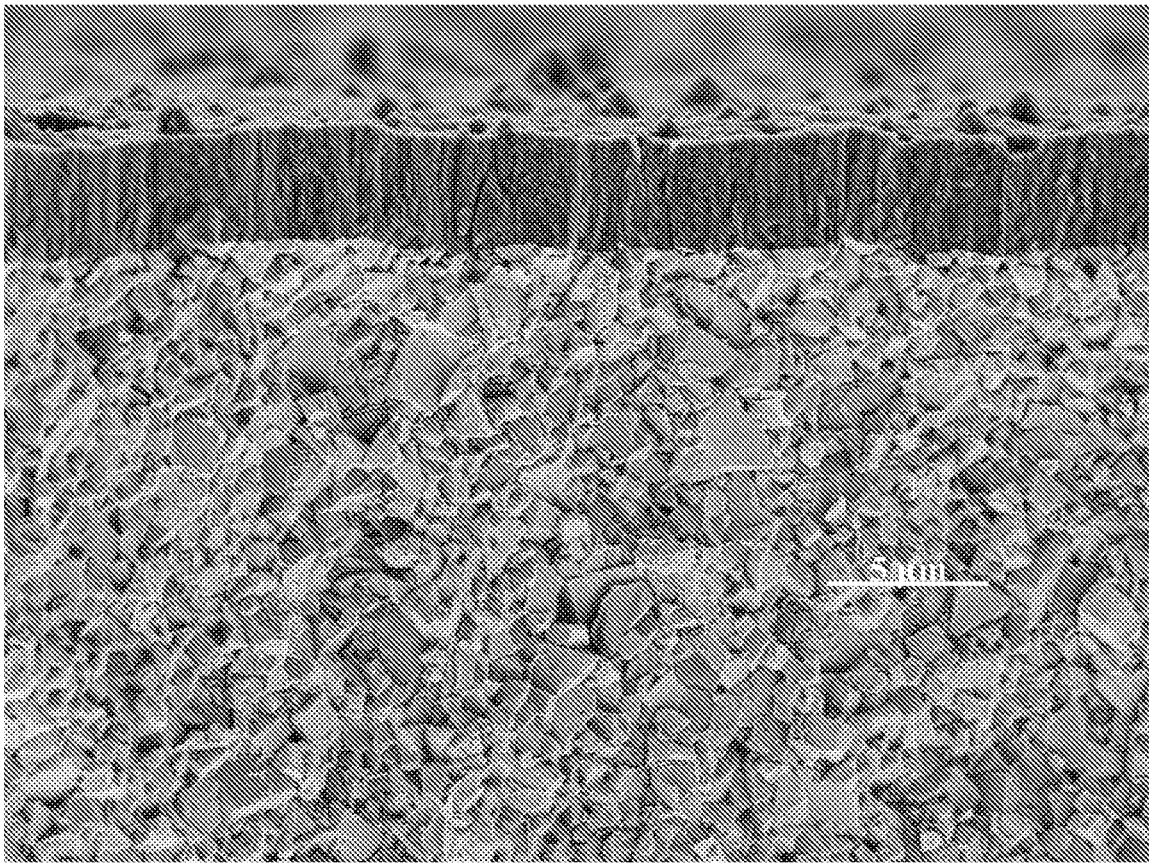
5 μm

COATED CUTTING TOOL FOR GENERAL TURNING IN HEAT RESISTANT SUPER ALLOYS (HRSA)

CROSS REFERENCE TO RELATED APPLICATIONS

This application is a division of application Ser. No. 12/195,578 filed on Aug. 21, 2008; which claimed priority to Swedish application 0701910-2 filed Aug. 24, 2007. The entire contents of each of the above-identified applications are hereby incorporated by reference.

FIELD OF THE INVENTION

The present invention relates to cutting tool inserts containing a cemented carbide substrate and a coating, particularly useful for general turning of heat resistant super alloys. Fine grained substrate in combination with a thick physical vapor deposition (PVD)-coating with a reduced residual strain level greatly improves the wear resistance.

BACKGROUND OF THE INVENTION

Superalloys are a broad range of nickel-, iron-, and cobalt-based alloys developed specifically for applications demanding exceptional mechanical and chemical properties at elevated temperatures. The classic use for these alloys is in the hot end of aircraft engines and land based turbines. Almost every metallurgical change made to improve the high temperature properties makes it more difficult to machine these alloys.

As high temperature strength is increased, the alloys become harder and stiffer at the cutting temperature. It results in increased cutting forces and increased wear on the cutting edge during machining.

Because stronger materials generate more heat during chip formation and because the thermal heat conductivity of these alloys is relatively low, very high cutting temperatures are generated, which also contributes to an increased wear of the cutting edge.

To make matters even worse, as the alloys are heat treated to modify the as-cast or solution treated properties, abrasive carbide precipitates or other second phase particles often form. These particles do also cause rapid wear of the cutting edge.

What is needed is a cutting tool insert containing coated cemented carbide, for general wet machining of superalloys, with improved wear resistance. The invention is directed to these, as well as other, important needs.

SUMMARY OF THE INVENTION

In one aspect, the invention is directed to cutting tool inserts, comprising a cemented carbide body and a coating particularly useful in general turning of superalloys, wherein the cemented carbide body comprises:

WC;

5.0-7.0, preferably 5.5-6.5, wt-% Co;

0.22-0.43, preferably 0.24-0.33, wt %-Cr; and wherein the cemented carbide body has a coercivity, Hc, of about 19-28, preferably about 21-27, kA/m; and wherein the coating comprises one layer of $(Ti_xAl_{1-x})N$, where x is about 0.25-0.50, preferably about 0.30-0.40 with a crystal structure of NaCl type and a total thickness of the layer of $(Ti_xAl_{1-x})N$ of about 3.0-5.0 μm, preferably about 3.5-4.5 μm, measured on the middle of the flank face with a compressive residual strain of about $2.5\times10^{-3}$-$5.0\times10^{-3}$, preferably about $3.0\times10^{-3}$-$4.0\times10^{-3}$, and with a texture coefficient TC(200) of about 1.6-2.1, the texture coefficient (TC) being defined as:

$$TC(hkl) = \frac{I(hkl)}{I_0(hkl)}\left[\frac{1}{n}\sum_{n=1}^{n}\frac{I(hkl)}{I_0(hkl)}\right]^{-1}$$

where

I(hkl)=intensity of the (hkl) reflection $I_O$(hkl)=standard intensity according to JCPDS card no 38-1420

N=number of reflections used in the calculation (hkl) reflections used are: (111), (200), and (220).

In another aspect, the invention is directed to methods for making a cutting tool insert, comprising a cemented carbide body and a coating particularly useful in general turning of superalloys, comprising the steps of:

preparing a substrate by milling, pressing and sintering a composition comprising:

WC;

5.0-7.0, preferably 5.5-6.5 wt-% Co;

0.22-0.43, preferably 0.24-0.33, wt %-Cr; and wherein said substrate has a coercivity, Hc, of about 19-28, preferably 21-27 kA/m; and depositing a single layer of $(Ti_xAl_{1-x})N$ on the substrate, where x is 0.25-0.50, preferably about 0.30-0.40, with a crystal structure of NaCl type and a total thickness of about 3.0-5.0 μm, preferably about 3.5 and 4.5 μm, measured on the middle of the flank face with a compressive residual strain of about $2.5\times10^{-3}$-$5.0\times10^{-3}$, preferably about $3.0\times10^{-3}$-$4.0\times10^{-3}$ and with a texture coefficient TC(200) of about 1.6-2.1, the texture coefficient (TC) being defined as:

$$TC(hkl) = \frac{I(hkl)}{I_0(hkl)}\left[\frac{1}{n}\sum_{n=1}^{n}\frac{I(hkl)}{I_0(hkl)}\right]^{-1}$$

where

I(hkl)=intensity of the (hkl) reflection $I_O$(hkl)=standard intensity according to JCPDS card no 38-1420 n=number of reflections used in the calculation (hkl) reflections used are: (111), (200), (220).

using arc evaporation of an alloyed, or Ti+Al composite cathode, wherein the cathode comprises about 25-50 at-% Ti, preferably 30 to 40 at-% Ti, and a current about 50-200 A depending on cathode size and cathode material, the substrate bias of about −20 V-−35 V, a deposition temperature of about 400° C.-700° C. and grown in an $Ar+N_2$ atmosphere containing 0-50 vol-% Ar, preferably 0-20 vol-%, at a total pressure of 1.0 Pa to 7.0 Pa.

In yet other aspects, the invention is directed to methods for machining of a superalloy, comprising the step of:

using a cutting tool insert described herein.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIG. 1 shows a fracture surface of a coated cemented carbide substrate according to the present invention in which:

1. Cemented carbide body and
2. Single layer of (Ti, Al)N.

DETAILED DESCRIPTION OF THE INVENTION

It has now surprisingly been found that a cemented carbide with low Co-content and submicron tungsten carbide (WC)-grain size coated with a single (Ti, Al)N-layer grown using physical vapor deposition greatly improves the productivity in general machining of superalloys under wet conditions.

According to the present invention there is now provided a coated cutting tool insert consisting of a substrate and a coating. The substrate contains tungsten carbide (WC), about 5.0-7.0, preferably about 5.5-6.5, most preferably about 5.8-6.2, wt-% Co, about 0.22-0.43, preferably about 0.24-0.33, most preferably about 0.26-0.29, wt-% Cr with a coercivity (Hc) of about 19-28, preferably about 21-27, preferably about 22.5-26.5 kA/m. Preferably, the edge radius of the inserts before coating is about 15-30 μm.

The coating contains a single layer of $(Ti_xAl_{1-x})N$, where x is about 0.25-0.50, preferably about 0.30-0.40, most preferably about 0.33-0.35. The crystal structure of the (Ti, Al)N-layer is of NaCl type. The total thickness of the layer is about 3.0-5.0 μm, preferably about 3.5-4.5 μm. The thickness is measured on the middle of the flank face.

The layer is strongly textured in the (200)-direction, with a texture coefficient TC(200) of about 1.6-2.1.

The texture coefficient (TC) is defined as follows:

$$TC(hkl) = \frac{I(hkl)}{I_0(hkl)}\left[\frac{1}{n}\sum_{n=1}^{n}\frac{I(hkl)}{I_0(hkl)}\right]^{-1}$$

where

I(hkl)=intensity of the (hkl) reflection $I_O$(hkl)=standard intensity according to JCPDS card no 38-1420 n=number of reflections used in the calculation (hkl) reflections used are: (111), (200), and (220).

The layer is in compressive residual stress with a strain of about $2.5\times10^{-3}$-$5.0\times10^{-3}$, preferably about $3.0\times10^{-3}$-$4.0\times10^{-3}$.

On top of the (Ti, Al)N, a TiN-layer of a thickness of about 0.1-0.5 μm may be deposited.

The present invention also relates to a method of making a coated cutting tool insert consisting of a substrate and a coating. The substrate is made by conventional powder metallurgical methods milling, pressing, and sintering. It has a composition comprising WC, about 5.0-7.0, preferably about 5.5-6.5, most preferably about 5.8-6.2, wt-% Co, about 0.22-0.43, preferably about 0.24-0.33, most preferably about 0.26-0.29, wt-% Cr with a coercivity (Hc) of about 19-28, preferably about 21-27, most preferably about 22.5-26.5, kA/m.

Before coating, the inserts are edge-honed by wet-blasting to an edge radius of preferably about 15-30 μm.

The method used to grow the layer is based on arc evaporation of an alloyed, or composite cathode, under the following conditions: The Ti+Al cathode composition is about 25-50 atomic share (at-%) Ti, preferably about 30-40 at-% Ti, most preferably about 33-35 at-% Ti.

Before coating the surface is cleaned preferably by applying a soft ion etching. The ion etching is performed in an Ar atmosphere or in a mixture of Ar and $H_2$.

The evaporation current is about 50-200 A. depending on cathode size and cathode material. When using cathodes of about 63 mm in diameter the evaporation current is preferably about 60-100 A. The substrate bias is about −20-−35 V. The deposition temperature is about 400-700° C., preferably about 500-600° C.

The (Ti,Al)N-layer is grown in an Ar+$N_2$ atmosphere consisting of about 0-50 vol-% Ar, preferably about 0-20 vol-%, at a total pressure of about 1.0-7.0 Pa, preferably about 3.0-5.5 Pa.

On top of the (Ti,Al)N-layer a TiN-layer of about 0.1-0.5 μm thickness may be deposited using Arc evaporation as known.

The present invention also relates to the use of inserts according to the above for wet machining of superalloys, such as Inconel 718, Inconel 625, Nimonic 81, Waspaloy or Ti6Al4V, at a cutting speed of about 20-75 m/min, a cutting depth about 0.2-2.5 mm and a feed of about 0.05-0.30 mm/rev.

Unless defined otherwise, all technical and scientific terms used herein have the same meaning as commonly understood by one of ordinary skill in the art to which this invention belongs. Although any methods and materials similar or equivalent to those described herein can be used in the practice or testing of the present invention, the preferred methods and materials are now described. All publications mentioned hereunder are incorporated herein by reference. Unless mentioned otherwise, the techniques employed or contemplated herein are standard methodologies well known to one of ordinary skill in the art. The materials, methods, and examples are illustrative only and not limiting.

The present invention is further defined in the following Examples, in which all parts and percentages are by weight and degrees are Celsius, unless otherwise stated. It should be understood that these examples, while indicating preferred embodiments of the invention, are given by way of illustration only. From the above discussion and these examples, one skilled in the art can ascertain the essential characteristics of this invention, and without departing from the spirit and scope thereof, can make various changes and modifications of the invention to adapt it to various usages and conditions.

EXAMPLE 1

Cemented carbide cutting tool inserts of type CNMG120412-MR3 and CNMG120408-MF1 consisting of a substrate and a coating were prepared. The substrate was made by milling, pressing and sintering. The composition was 5.9 wt-% Co, 0.27 wt-% Cr and rest WC. The coercivity was 24.0 kA/m corresponding to an average WC grain size of about 0.80 μm.

The inserts were wet-blasted to an edge-radius of 25 μm.

The coating was grown using arc evaporation of a $Ti_{0.34}Al_{0.66}$ cathode, 63 mm in diameter. The deposition was carried out in a 99.995% pure $N_2$ atmosphere at a total pressure of 4.5 Pa, using a substrate bias of −30 V for 60 minutes. The deposition temperature was about 530° C. The thickness of the layer was 3.8 μm in the middle of the flank face. X-ray diffraction showed a strong (002)-texture with (TC)=1.8 and a residual strain of $3.5*10^{-3}$.

FIG. 1 shows a fracture surface of the insert.

EXAMPLE 2

CNMG120412-MR3 coated inserts from Example 1 were tested with regard to wear resistance in longitudinal medium-rough turning at the following conditions.

Work piece: Cylindrical bar
Material: Inconel 718
Cutting speed: 50 m/min
Feed: 0.25 mm/rev
Depth of cut: 2.0 mm
Remarks: Flood coolant
Reference: Seco CP200

Results

The tool life criterion was the maximum time in cut in minutes at a cutting speed of 50 m/min giving a flank wear of 0.2 mm. The results are found in Table 1.

TABLE 1

| Grade | Time in cut [min] |
|---|---|
| Invention | 8.50 |
| Seco CP200 | 6.00 |

This test shows that the inserts according to the invention achieve about 40% longer tool life than Seco CP200.

EXAMPLE 3

CNMG120408-MF1 coated inserts from Example 1 were tested with regard to wear resistance in longitudinal fine turning at the conditions below.

Work piece: Cylindrical bar
Material: Inconel 718
Cutting speed: 55, 70 m/min
Feed: 0.15 mm/rev
Depth of cut: 0.5 mm
Remarks: Flood coolant
Reference: Seco CP200

Results

The time in minutes to a flank wear of 0.2 mm was measured. The results are found in Table 2.

TABLE 2

| Cutting speed | 55 | 70 |
|---|---|---|
| Invention | — | 7.00 |
| Seco CP200 | 7.00 | 5.00 |

This test shows that the inserts according to the invention increase tool life productivity by 40% compared to Seco CP200.

EXAMPLE 4

CNMG120412-MR3 coated inserts from Example 1 were tested with regard to tool life in a medium-rough boring operation at the conditions below.

Work piece: Special component
Material: Inconel 718
Cutting speed: 37 m/min
Feed: 0.20 mm/rev
Depth of cut: 3.2 mm
Remarks: Flood coolant
Reference: Competitor grade Results Reference grade machined reached full tool life after 7 minutes and 40 seconds. The inserts according to the invention reached full tool life after 11 minutes and 50 seconds.

This test shows that the inserts according to the invention increase tool life up to 50%.

When ranges are used herein for physical properties, such as molecular weight, or chemical properties, such as chemical formulae, all combinations and subcombinations of ranges specific embodiments therein are intended to be included.

The disclosures of each patent, patent application, and publication cited or described in this document are hereby incorporated herein by reference, in their entirety.

Those skilled in the art will appreciate that numerous changes and modifications can be made to the preferred embodiments of the invention and that such changes and modifications can be made without departing from the spirit of the invention. It is, therefore, intended that the appended claims cover all such equivalent variations as fall within the true spirit and scope of the invention.

The invention claimed is:

1. A method for making a cutting tool insert, comprising:

preparing a substrate by milling, pressing and sintering a composition comprising: WC; 5.0-7.0 wt-% Co; 0.22-0.43 wt-% Cr; and wherein said substrate has a coercivity Hc of about 19-28 kA/m; and depositing a single layer of $(Ti_xAl_{1-x})N$ on the substrate, where x is 0.25-0.50, with a crystal structure of NaCl configuration and a total thickness of about 3.0-5.0 μm, measured on the middle of the flank face with a compressive residual strain of about $2.5\times10^{-3}$-$5.0\times10^{-3}$, and with a texture coefficient TC(200) of about 1.6-2.1, the texture coefficient (TC) being defined as:

$$TC(hkl) = \frac{I(hkl)}{I_0(hkl)}\left[\frac{1}{n}\sum_{n=1}^{n}\frac{I(hkl)}{I_0(hkl)}\right]^{-1}$$

where

I(hkl)=intensity of the (hkl) reflection, $I_O$(hkl)=standard intensity according to JCPDS card no 38-1420, n=number of reflections used in the calculation, (hkl) reflections used are: (111), (200), (220), utilizing arc evaporation of an alloyed, or Ti+Al composite cathode, wherein the cathode comprises about 25-50 at-% Ti, and a current about 50-200, the substrate bias of about −20V to −35V, a deposition temperature of about 400° C.-700° C. and grown in an $Ar+N_2$ atmosphere containing 0-50 vol-% Ar, at a total pressure of 1.0 Pa to 7.0 Pa.

2. The method according to claim 1, wherein the $Ar+N_2$ atmosphere contains 0-20 vol-% Ar.

3. The method according to claim 1, wherein the composition comprises about 5.5-6.5 wt-% Co.

4. The method according to claim 1, wherein the composition comprises about 0.24-0.33 wt %-Cr.

5. The method according to claim 1, wherein the coercivity Hc of the composition is about 21-27 kA/m.

6. The method according to claim 1, wherein x is about 0.30-0.40.

7. The method according to claim 1, wherein the total thickness of the layer of $(Ti_xAl_{1-x})N$ is about 3.5-4.5 μm.

8. The method according to claim 1, wherein the compressive residual strain is about $3.0\times10^{-3}$-$4.0\times10^{-3}$.

9. The method according to claim 1, wherein the cathode comprises about 30-40 at-% Ti.

10. The method according to claim 1, further comprising:

depositing, with arc evaporation, an outermost TiN layer, wherein the TiN layer has a thickness of about 0.1-0.5 μm.

11. The method according to claim 1, wherein the insert is edge-honed by wet-blasting.

12. The method according to claim 11, wherein the insert is edge-honed to an edge radius of about 15-30 μm before the depositing step.

13. A method for machining of a superalloy, comprising:

machining with a cutting tool insert comprising:

a cemented carbide body and a coating, wherein the cemented carbide body comprises:

WC;

5.0-7.0 wt-% Co;

0.22-0.43 wt-% Cr; and wherein the cemented carbide body has a coercivity Hc of about 19-28 kA/m; and wherein the coating comprises one layer of $(Ti_xAl_{1-x})N$, where x is about 0.25-0.50, with a crystal structure of NaCl type and a total thickness of the layer of $(Ti_xAl_{1-x})N$ of about 3.0-5.0 μm, measured on the middle of the flank face with a compressive residual strain of about $2.5\times10^{-3}$ and $5.0\times10^{-3}$, and with a texture coefficient TC(200) of about 1.6-2.1, the texture coefficient (TC) being defined as:

$$TC(hkl) = \frac{I(hkl)}{I_0(hkl)}\left[\frac{1}{n}\sum_{n=1}^{n}\frac{I(hkl)}{I_0(hkl)}\right]^{-1}$$

where

I(hkl)=intensity of the (hkl) reflection, $I_O$(hkl)=standard intensity according to JCPDS card no 38-1420, N=number of reflections used in the calculation, (hkl) reflections used are: (111), (200), and (220).

14. The method of claim 13, wherein the machining is conducted at a cutting speed of about 20-75 m/min, a cutting depth of about 0.2-2.5 mm, and at a feed of about 0.05-0.30 mm/rev.

15. The method of claim 13, wherein the composition comprises about 5.5-6.5 wt-% Co.

16. The method of claim 13, wherein the composition comprises about 0.24-0.33 wt-% Cr.

17. The method of claim 13, wherein coercivity Hc of the composition is about 21-27 kA/m.

18. The method of claim 13, wherein x is about 0.30-0.40.

19. The method of claim 13, wherein the total thickness of the layer of $(Ti_xAl_{1-x})N$ is about 3.5-4.5 μm.

20. The method of claim 13, wherein the compressive residual strain is about $3.0\times10^{-3}$-$4.0\times10^{-3}$.

* * * * *